US005542273A

United States Patent [19]

Bednarz

[11] Patent Number: 5,542,273

[45] Date of Patent: Aug. 6, 1996

[54] POSITIVE ACTING BARREL LOCK

[76] Inventor: James W. Bednarz, 1025 W. Crosby, Slaton, Tex. 79364

[21] Appl. No.: 344,747

[22] Filed: Nov. 23, 1994

[51] Int. Cl.[6] ..... F05B 67/36

[52] U.S. Cl. ..... 70/34; 29/263; 70/164; 70/386; 81/55; 81/177.85; 292/252; 292/327; 411/348; 411/402

[58] Field of Search ..... 70/34, 164, 229–232, 70/386; 292/252, 327; 411/21, 348, 402; 29/263; 24/453; 81/55, 57.42, 177.85

[56] References Cited

U.S. PATENT DOCUMENTS

| | | | |
|---|---|---|---|
| 1,244,848 | 10/1917 | Gadke | 411/21 X |
| 1,462,783 | 7/1923 | Barbarou | 292/252 |
| 2,232,340 | 2/1941 | Olson | 411/348 X |
| 2,685,877 | 8/1954 | Dobelle | 411/21 X |
| 2,822,986 | 2/1958 | Schreier | 411/348 X |
| 3,180,390 | 4/1965 | Ockert, Jr. | 411/348 |
| 3,390,712 | 7/1968 | McKay | 411/348 X |
| 3,498,653 | 3/1970 | McCreery | 411/348 X |
| 3,889,558 | 6/1975 | Duncan | 81/55 |
| 4,699,408 | 10/1987 | Kesselman | 292/327 X |
| 4,733,584 | 3/1988 | Karge | 81/177.85 |

FOREIGN PATENT DOCUMENTS

| | | | |
|---|---|---|---|
| 0663801 | 8/1938 | Germany | 411/348 |
| 195403 | 7/1938 | Switzerland | 411/348 |
| 17310 | 12/1915 | United Kingdom | 292/252 |
| 0575355 | 2/1946 | United Kingdom | 411/348 |

*Primary Examiner*—Lloyd A. Gall
*Attorney, Agent, or Firm*—Robert J. Harter

[57] ABSTRACT

A barrel lock includes a cylindrical plug with a locking ball actuated by a positive acting threaded pin that is screwed into the plug. The plug slips into a mating cylindrical retainer and is locked in place by the pin forcing the ball to protrude beyond tile exterior of the cylindrical plug. An anti-rotation coupling that includes a key attaches to the plug which makes the barrel lock especially easy to install and operate. A threaded puller assures separation of the plug and retainer even when the barrel lock may be jammed due to earlier tampering. The simplicity of the invention provides for a rugged construction with positive sealing surfaces that protect against contaminants and corrosion.

13 Claims, 6 Drawing Sheets

POSITIVE ACTING BARREL LOCK

FIELD OF THE INVENTION

The subject invention generally pertains to barrel locks and more specifically to one employing ball and mandrel actuation.

DESCRIPTION OF RELATED ART

Barrel locks are typically used to inhibit tampering with public utility devices such as valves and meters for gas, water and electricity. A common barrel lock is the plunger style. It incorporates two balls which are held in the extended, locked position by a spring loaded tapered mandrel. The number of different key shapes is very limited, the keys are easily duplicated, and common objects can be used to open the lock. The design of the plunger style barrel lock is such that it holds water, suffers from corrosion and becomes inoperable in freezing temperatures. It is also easily disabled by simply inserting a foreign object into the key hole. The head is generally swaged onto the barrel and is easily broken off.

In an effort to combat the above security problems, barrel locks have become increasingly intricate and complex in design. They incorporate numerous delicate parts such as stacked discs, pins, tumblers, and springs. Given the fact that these barrel locks are most generally exposed to the elements, the many close fitting parts are very susceptible to corrosion and contamination. In order to get more parts in the head of the barrel lock, the wall section of the head has been decreased to the point that it is very easily broken off. To compensate for the weak heads of the above barrel locks, many lock housings are designed so that the entire head is recessed in a protective shroud. This has lead to another problem, that of the barrel lock rotating within the housing when the key is turned. Additionally, few, if any, of these barrel lock styles are rekeyable, rebuildable or sealable. Some art relating to barrel locks are disclosed in U.S. Pat. No. 3,861,180; 3,172,282; 1,923,025; 3,714,802; 4,040,279; 4,313,319; 4,742,703; 4,945,738; 4,986,096; 4,674,304; and 4,702,093 all of which are specifically incorporated by reference herein.

SUMMARY OF THE INVENTION

To avoid the limitations and problems with present barrel locks, it is a primary object of this invention to provide a simplified barrel lock by reducing the required number of basic parts to three, i.e., a threaded plug body, a threaded pin, and a ball.

Another object of the invention is to eliminate the need for any delicate springs or stacked discs.

Another object is to provide a plug having a nearly flush head that is nearly impossible to grip with a commonly available wrench or break off with a hammer blow from the side.

Another object is to provide many different individual key shapes by simply varying the numbers of points on a given diameter, as well as varying the diameters themselves.

Yet another object is to provide a snap-in plastic cap that seals out contaminants and serves as an indicator of any tampering.

A feature of the invention is a threaded pin having a positive acting in and out motion for reliable actuation of the barrel lock.

Another feature of the invention are positive sealing surfaces for protection against contamination, corrosion, and freezing.

Another feature of the invention is that it is rekeyable by simply installing a pin with a different head shape.

An object of the invention is to combine a key and an anti-rotation coupling into a single tool.

Another object of the invention is to provide a means for forcibly extracting a plug seized within its retainer.

A further object is to have a puller and an anti-rotation coupling use the same anti-rotation means.

These and other objects and features of the invention are provided by a novel barrel lock that includes a plug having a locking ball actuated by a positive acting threaded pin that is screwed into the plug. The plug slips into a mating cylindrical retainer and is locked in place by the pin forcing the ball to protrude beyond an edge along the inside of the retainer.

DESCRIPTION OF PREFERRED EMBODIMENT STRUCTURE

Figure 1:
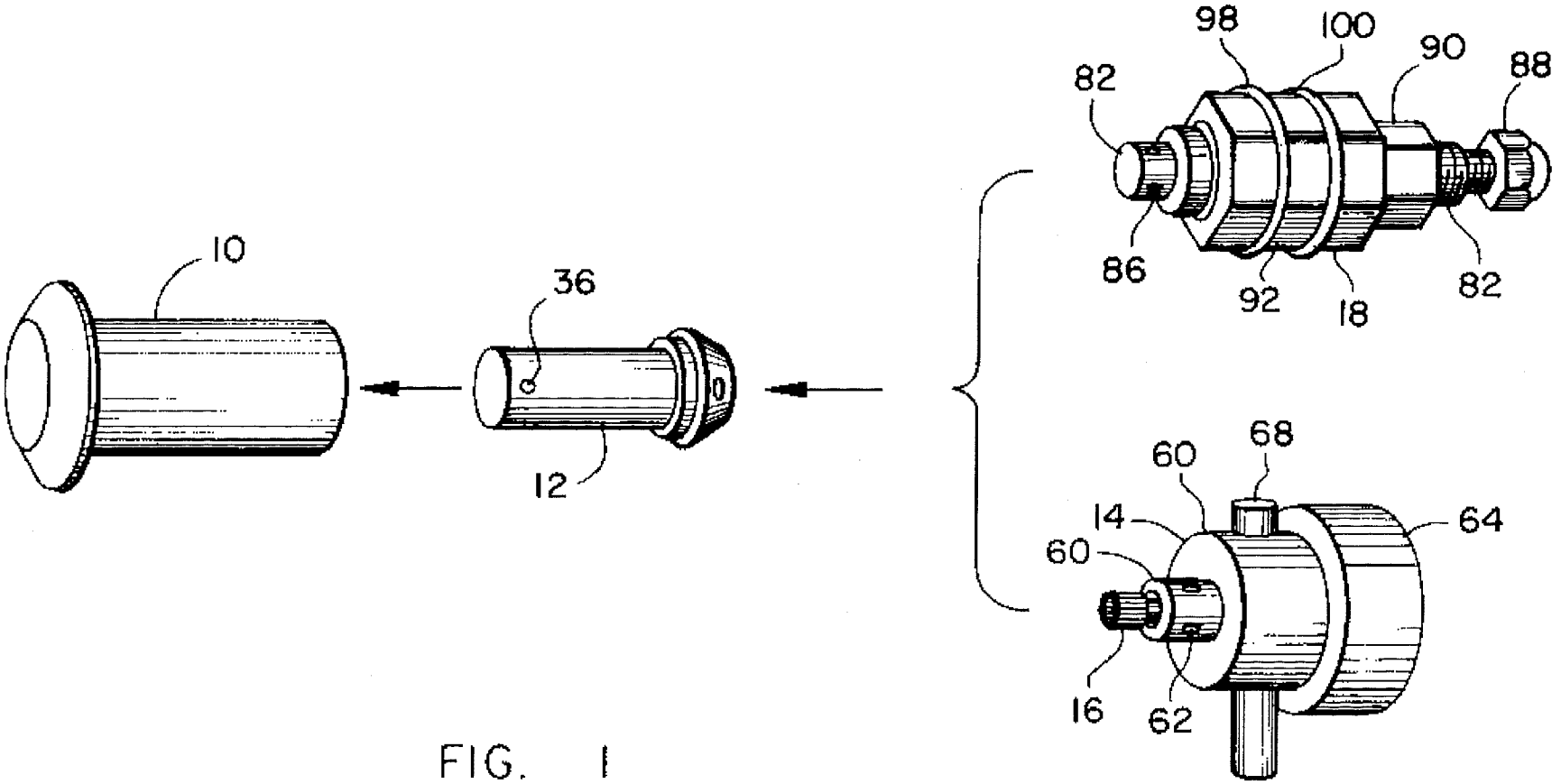
FIG. 1 is a perspective view of the invention.
Figure 2:
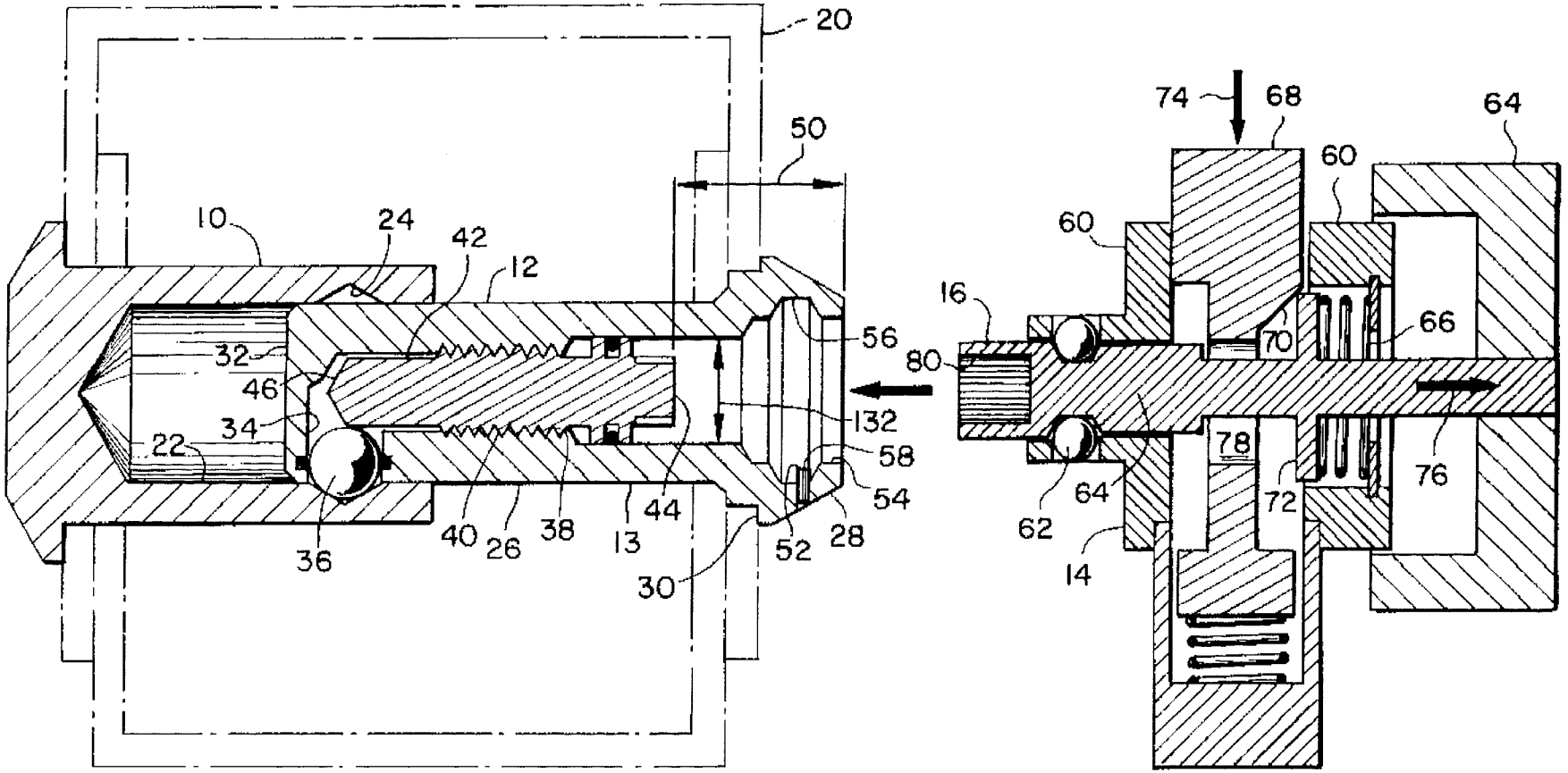
FIG. 2 is a cross-sectional view of a locked barrel lock about to be unlocked.

Referring to FIG. 1, this invention includes five basic components, a retainer 10, a plug 12, an anti-rotation coupling 14, a key 16, and a puller 18. Plug 12 and retainer 10 are interlockable to secure an enclosure 20 (FIG. 2). Enclosure 20 represents any one of a variety of devices that inhibits tampering with public utility devices such as valves and meters for gas, water and electricity.

Referring to FIG. 2, retainer 10 has an opening 22 with an annular edge 24 therearound.

Plug 12 has a one-piece plug body 13 having an exterior 26 sized to slip into retainer 10. Plug 12 is open at one end where it has a head 28 having radially protruding shoulder 30. Toward an opposite end 32 of plug 12 there is a radial bore 34 containing a steel ball 36. The interior of plug 12 includes a longitudinal threaded hole 38 engaged by external threads 40 of a pin 42. Pin 42 has a driven end 44 and a driving end 46. Driven end 44 is engagable by a key 16 and is recessed within plug 12 as indicated by dimension 50. Driving end 46 engages ball 36.

Plug 12 also includes a stop 52 situated within the interior bore 54 of head 28. In one embodiment of the invention, stop 52 is an annular groove 56 interrupted by a radial protrusion that is integrally formed in plug 12. Stop 52 can also be a separate item such as a pin 58. Pin 58 is an optional item that is press fitted into plug body 13.

Stop 52 works in conjunction with anti-rotation coupling 14. Coupling 14 includes a body 60 that houses four radially sliding balls 62 whose movement is controlled by the axial position of a tapered mandrel 64. A compression spring 66 acting between mandrel 64 and body 60 causes mandrel 64 to urge balls 62 radially outward. A spring return push button 68 is used to retract balls 62 within body 60. Button 68 includes a cam surface 70 that engages flange 72 of mandrel 64. Pushing button 68 in direction 74 causes cam 70 to move mandrel 64 in direction 76, thereby releasing balls 62. Relative movement between button 68 and mandrel 64 is facilitated by slot 78 in button 68.

In one embodiment of the invention, key 16 is incorporated in anti-rotation coupling 14. Key 16 is an integral part of mandrel 64. Key 16 has a relatively intricate cavity 80 that matches driven end 44 of pin 42. Driven end 44 of pin 42 fits into cavity 80.

Figure 3:
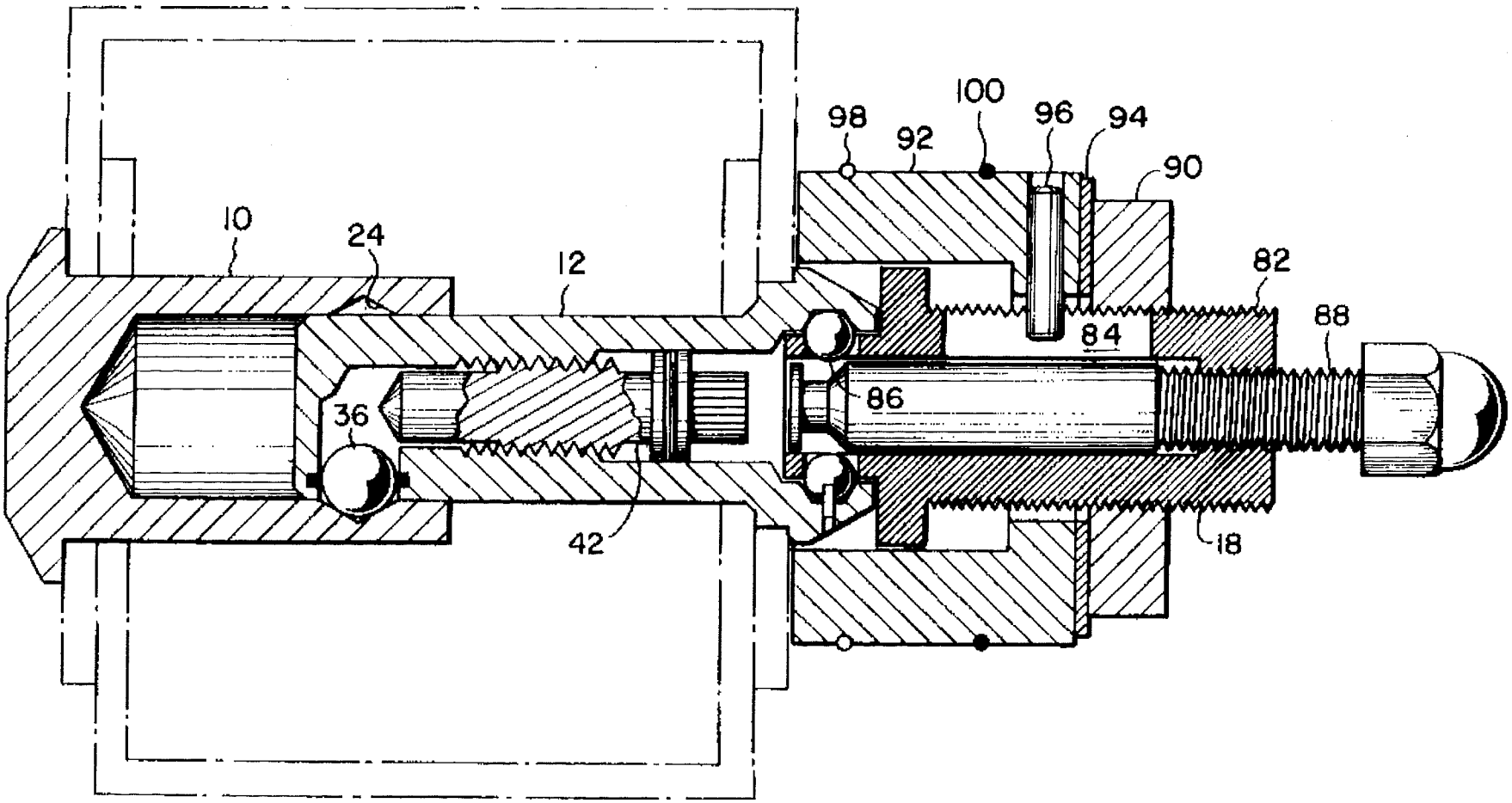
FIG. 3 is a cross-sectional view showing an unlocked barrel lock with a puller in position to draw the plug out of its retainer.

Puller 18 is the fifth mentioned component of the invention and is shown in FIG. 3. Puller 18 includes a threaded body 82 with a longitudinal slot 84 and four radially sliding balls 86. The radial position of balls 86 is determined by the axial position of a threaded mandrel 88 that is screwed into body 82. A drive nut 90 is screwed onto body 82 and a slide nut 92 slips over body 82. Drive nut 90 and slide nut 92 are separated by a thrust washer 94. Slide nut 92 has a pin 96 that extends into slot 84 to limit the rotation of slide nut 92 relative to body 82.

Operation

Figure 4:
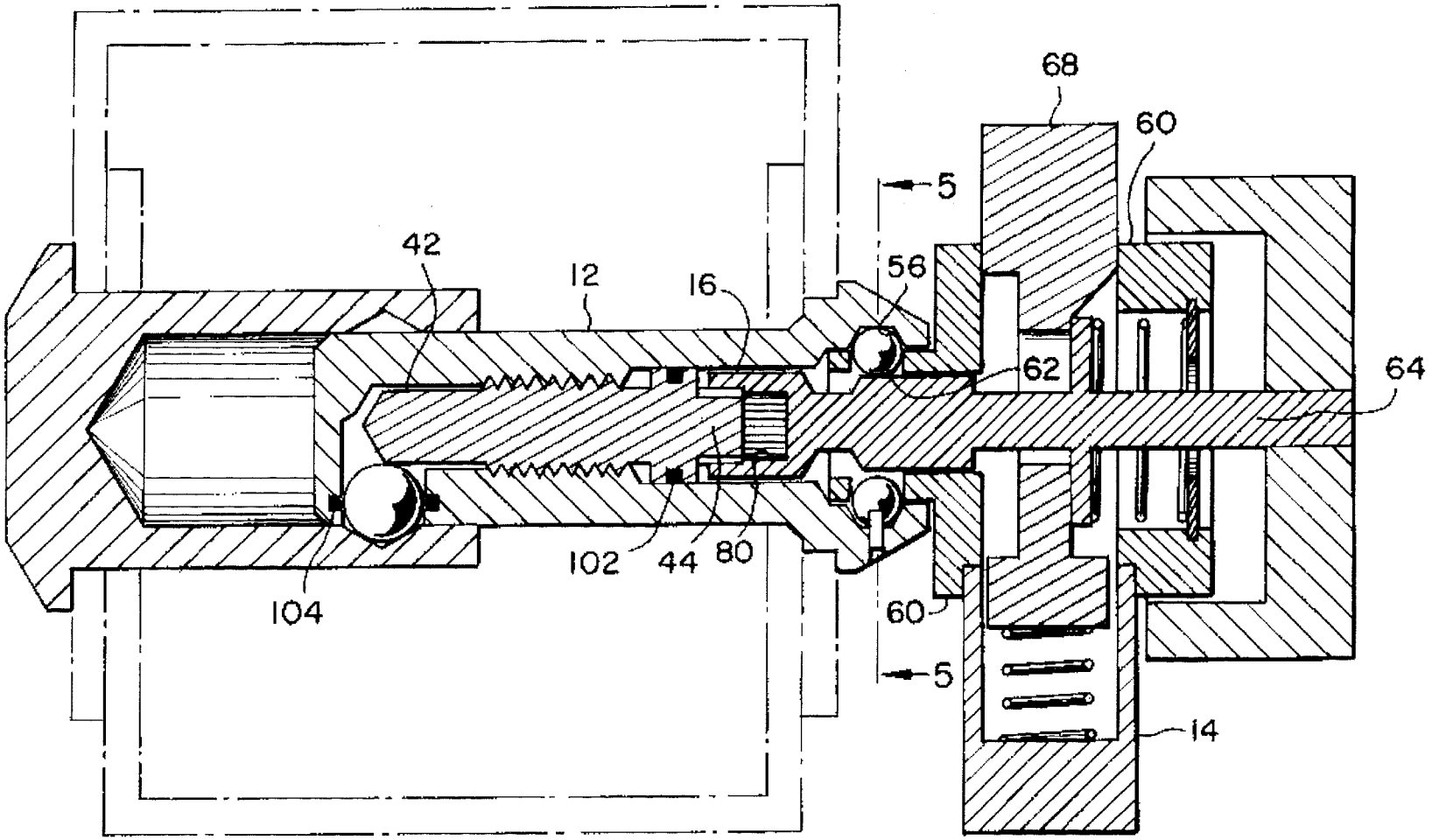
FIG. 4 is a cross-sectional view of an anti-rotation coupling and key engaging a barrel lock. Also shown is the anti-rotation coupling limiting the bi-directional longitudinal movement of the coupling relative to the plug.
Figure 5:
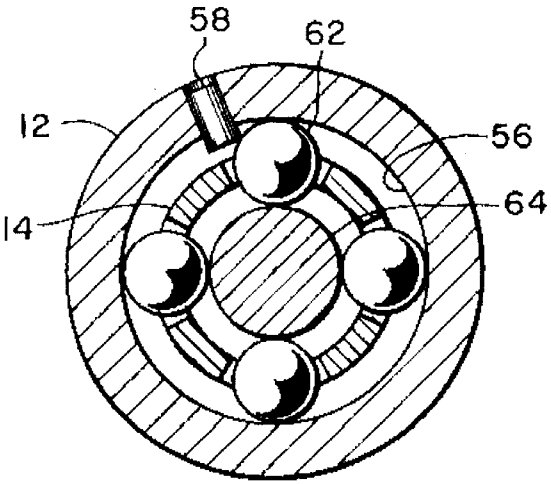
FIG. 5 is a cross-sectional view taken along line 5—5 of FIG. 4.

Plug 12 and retainer 10 are interlocked by first releasing ball 36 of plug 12 by retracting pin 42 from within plug 12 as plug 12, ball 36, and pin 42 are depicted in FIG. 3. Plug 12 is inserted into retainer 10 with ball 36 aligned to engage edge 24. Coupling 14, of FIG. 2, is attached to plug 12. This is done by depressing button 68 to release balls 62 and inserting coupling 14 into the open end of plug 12. Referring to FIG. 4, releasing button 68 causes mandrel 64 to push balls 62 outwardly into groove 56 and allows socket 80 of key 16 to engage driven end 44 of pin 42. FIG. 5 shows how balls 62 in groove 56 limit the axial movement between coupling 14 and plug 12. FIG. 5 shows how balls 62 in groove 56 in conjunction with pin 58 limits the rotation of coupling body 14 relative to plug 12. Hand rotation of mandrel 64 relative to body 60 screws pin 42 into plug 12 which forces ball 36 past edge 24 of retainer 10, thereby locking plug 12 and retainer 10 together. Once locked, coupling 14 is removed. The above sequence is reversed to unlock the barrel lock.

On occasion, however, corrosion can cause plug 12 to seize within retainer 10 even though pin 42 is sufficiently unscrewed. When this occurs, puller 18 is attached to plug 12 as shown in FIG. 3. One wrench (not shown) holds slide nut 92 stationary, while a second wrench (not shown) turns drive nut 90 against thrust washer 94. Torquing drive nut 90 forcibly draws plug 12 further into slide nut 92. Although damage may occur, ready access to the locked device is made possible.

Additional Features

In one embodiment of the invention, slide nut 92 includes a steel retaining ring 98 and a resilient O-ring 100 to removably hold a box wrench therebetween for easier operation (FIG. 3). Optional O-rings 102 and 104 are used to minimize contamination inside plug 12 (FIG. 4). Although four balls are used in coupling 14 and puller 18, other quantities would also work. Balls 36, 62, and 86 are captivated within their respective bores by staking the material near the perimeter of their bores. Although button 68 of FIG. 4 is schematically illustrated as a single piece, a two-piece assembly is used to facilitate assembly, as would be obvious to those skilled in the art.

Figure 6:
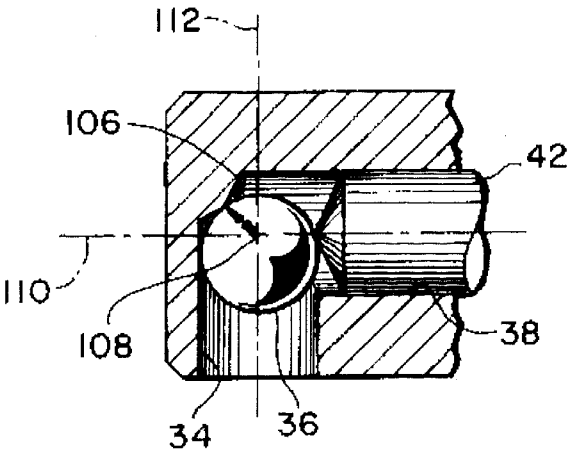
FIG. 6 is a partial cross-sectional view of a plug.

Referring to FIG. 6, the drilled depth of radial bore 34 and longitudinal threaded hole 38 is limited to produce a backstop 106. Backstop 106 represents any protrusion that helps prevent ball 36 from being jammed under pin 42. More specifically, the minimum distance between backstop 106 and a point of intersection 108 is less than the radius of ball 36. Intersection 108 is where the longitudinal centerline 110 of hole 38 intersects the longitudinal centerline 112 of bore 34.

Figure 8:
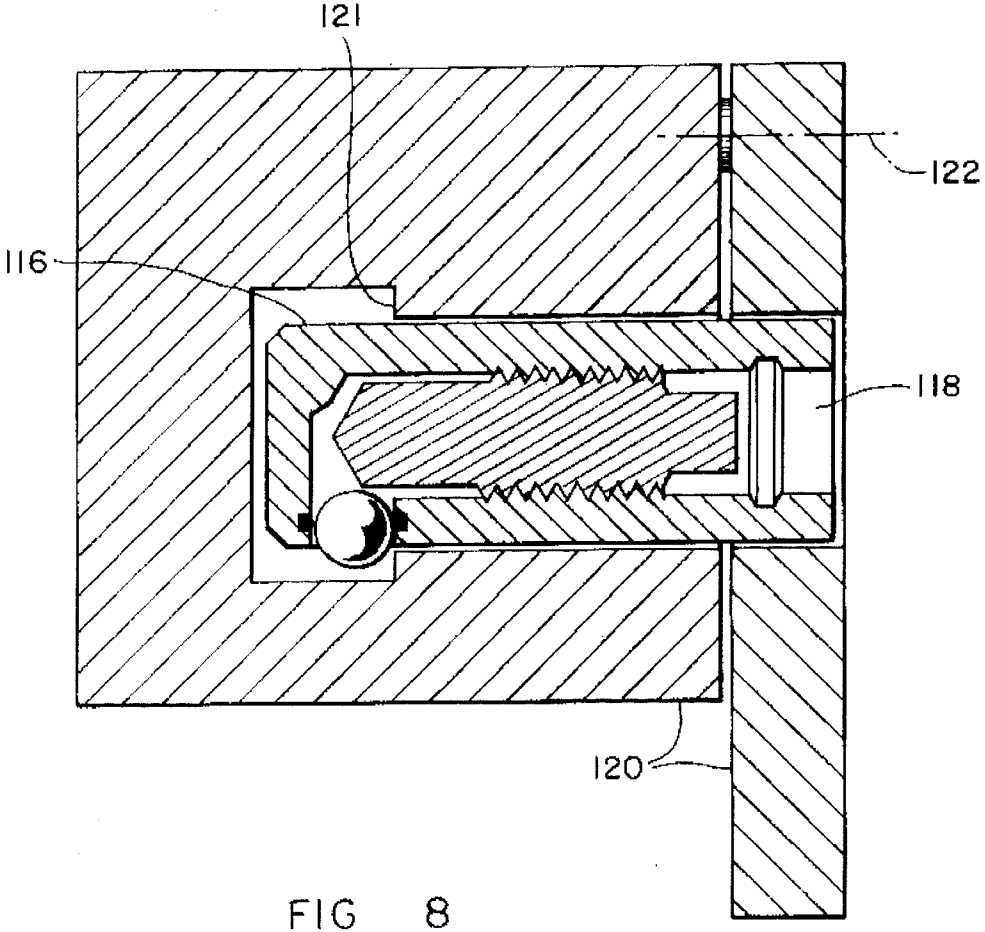
FIG. 8 shows a headless barrel lock.

FIG. 8 shows a barrel lock 116 having no head at its open end 118. Barrel lock 116 is completely recessed within a generically illustrated public utility device such as a retainer 120. Retainer 120 includes an edge 121. Retainer 120 is actuated by rotation about a centerline 122, and barrel lock 116 prevents such rotation.

Figure 9:
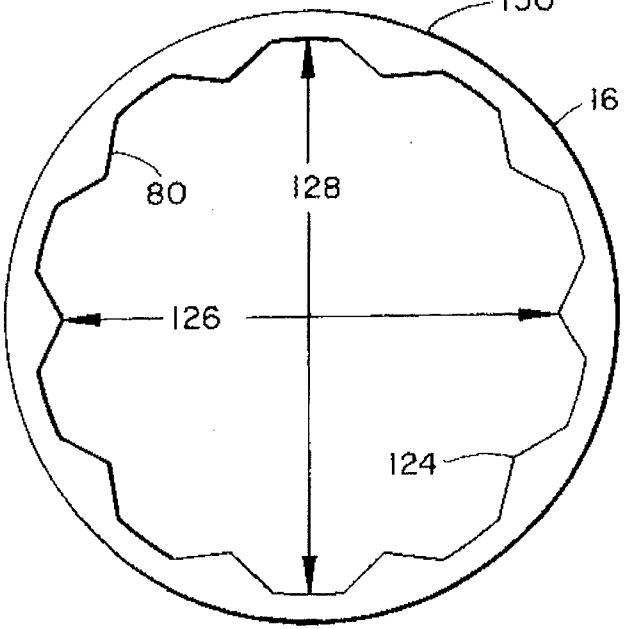
FIG. 9 is an enlarged view looking into the socket of the key shown in FIG. 2.

To prevent unlocking of the barrel lock with a conventional English or metric socket meant for hex head bolts, and more specifically 12 point bolts, a unique set of key designs were created. FIG. 9 is an opened view of key 16 showing the detail of a particular socket 80. Socket 80 includes ten points 124 and has a minor inside diameter 126 of 0.165 inches (0.155 to 0.175 inches), a major inside diameter 128 of 0.187 inches (0.177 to 0.197 inches), and an outside diameter 130 of 0.240 inches (0.220 to 0.260 inches). The inside diameter 132 of plug 12 (FIG. 2) is sized to provide a diametric clearance of less than 0.030 inches between plug 12 and key 16 to further inhibit tampering with a standard thick walled socket. Other effective key designs are possible by maintaining dimensions proportional to those just mentioned, and by using a number of points other than the standard six and twelve points.

Figure 7:
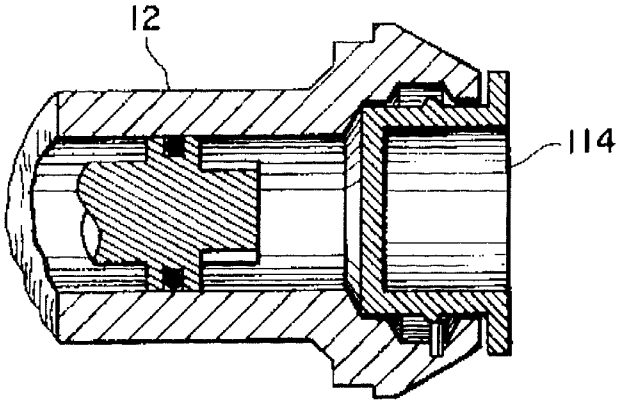
FIG. 7 is a cross-sectional view of a plug cap.

Another option is a plastic snap-in removable cap 114 for sealing the open end of plug 12, as shown in FIG. 7.

It should be noted, that the term "retainer" (e.g., retainer 10 and 120) is defined as any apparatus having an opening (e.g., opening 22) through which a plug (e.g., plugs 12 and 116) can fit, and whose opening has an edge (e.g., edges 24 and 121) adapted to engage a protruding ball 36.

Although the invention is described with respect to a preferred embodiment, modifications thereto will be apparent to those skilled in the art. Therefore, the scope of the invention is to be determined by reference to the claims which follow.

I claim:

1. A barrel lock adapted to engage a retainer having an annular edge defining an opening, said barrel lock comprising:

a plug having an exterior adapted to fit into said opening of said retainer, said plug having an interior defining a longitudinal threaded hole and a radial bore, said longitudinal threaded hole being open to an open end of said plug and said radial bore being by an opposite end of said plug and alignable with said annular edge of said retainer, said open end defining an interior bore in substantially co-linear alignment with said longitudinal threaded hole of said plug;

a ball situated within said radial bore and free to protrude radially outward beyond said exterior of said plug;

a pin having external threads engaging said longitudinal threaded hole of said plug, said pin having a driving end and a driven end, said driving end being adapted to positively engage said ball, said driven end being recessed within said plug;

a key adapted to reach into said plug and engage said driven end of said pin, whereby revolution of said key turns said pin selectively in and out of said longitudinal threaded hole of said plug to move said ball along said radial bore to selectively push said ball radially outward beyond said exterior of said plug and allow said ball to retract within said exterior of said plug;

a stop disposed within said interior bore of said open end; and an anti-rotation coupling engaging said stop to limit the relative rotation of said anti-rotation coupling and said plug, said anti-rotation coupling having said key pass therethrough.

2. The barrel lock of claim 1, wherein said interior bore of said open end defines an annular groove with said stop being a radial protrusion in said annular groove, said anti-rotation coupling having a plurality of balls and a mandrel whose axial movement urges said plurality of balls radially-outward into said annular groove to abut said radial protrusion upon rotation of said plug relative to said anti-rotation coupling.

3. The barrel lock of claim 1, wherein said key is rotatably connected to said anti-rotation coupling.

4. The barrel lock of claim 1, further comprising an annular groove defined by said interior bore of said open end and a plug puller comprising a nut threaded onto a threaded body, contained by said threaded body is a plurality of puller balls and a puller mandrel whose axial movement urges said plurality of puller balls radially outward into said annular groove to engage said plug and draw said plug out from within said retainer upon rotation of said nut relative to said threaded body.

5. The barrel lock of claim 1, further comprising a backstop surface on said interior of said plug and being spaced apart from a point of intersection a distance of less than the radius of said ball with said point of intersection being defined as that point which the longitudinal centerline of said longitudinal threaded hole intersects the longitudinal centerline of said radial bore, thereby avoiding the possibility of said ball being jammed against said pin at a location entirely within said interior of said plug.

6. The barrel lock of claim 1, further comprising a sealing cap selectively engaging and disengaging said interior bore of said plug and sealingly extending over said open end of said plug when engaged.

7. A barrel lock comprising:

a retainer having an annular edge defining an opening;

a plug having an exterior adapted to fit through said opening of said retainer, said plug having an interior defining a longitudinal threaded hole and a radial bore, said longitudinal threaded hole open to an open end of said plug and said radial bore being by an opposite end of said plug and alignable with said annular edge of said retainer;

a head with a radially protruding shoulder at said open end of said plug, said head having an interior bore in substantially co-linear alignment with said longitudinal threaded hole of said plug;

a ball situated within said radial bore and free to protrude radially outward beyond said exterior of said plug and against said annular edge of said retainer;

a pin having external threads engaging said longitudinal threaded hole of said plug, said pin having a driving end and a driven end, said driving end being adapted to positively engage said ball, said driven end being recessed within said plug;

a key adapted to reach into said plug and engage said driven end of said pin, whereby multiple revolutions of said key turns said pin selectively in and out of said longitudinal threaded hole of said plug to move said ball along said radial bore to selectively engage and disengage said ball from said annular edge of said retainer;

an anti-rotation coupling radially engaging said head of said plug to limit the relative rotation of said anti-rotation coupling and said plug, said anti-rotation coupling having said key pass therethrough; and a stop disposed on said interior bore of said head, said interior bore of said head defining an annular groove with said stop being a radial protrusion in said annular groove, said anti-rotation coupling having a plurality of balls and a mandrel whose axial movement urges said plurality of balls radially outward into said annular groove to abut said radial protrusion upon rotation of said plug relative to said anti-rotation coupling.

8. The barrel lock of claim 7, wherein said key is rotatably connected to said anti-rotation coupling.

9. The barrel lock of claim 7, further comprising a backstop surface on said interior of said plug and being spaced apart from a point of intersection a distance of less than the radius of said bail with said point of intersection being defined as that point which the longitudinal centerline of said longitudinal threaded hole intersects the longitudinal centerline of said radial bore, thereby avoiding the possibility of said ball being jammed against said pin at a location entirely within said interior of said plug.

10. The barrel lock of claim 7 further comprising a plug puller having a nut threaded onto a threaded body, contained by said threaded body is a plurality of puller balls and a puller mandrel whose axial movement urges said plurality of balls radially outward into said annular groove to grasp said plug and draw said plug out from within said retainer upon rotation of said nut relative to said threaded body.

11. The barrel lock of claim 7, further comprising a sealing cap selectively engaging and disengaging said interior bore of said plug and sealingly extending over said open end of said plug when engaged.

12. A barrel lock comprising:

a retainer having an annular edge defining an opening;

a plug having an exterior adapted to fit through said opening of said retainer, said plug having an interior defining a longitudinal threaded hole and a radial bore, said longitudinal threaded hole being open to an open end of said plug and said radial bore being by an opposite end of said plug and alignable with said edge of said retainer;

a head with a radially protruding shoulder at said open end of said plug, said head having an interior bore in substantially co-linear alignment with said longitudinal threaded hole of said plug, said interior bore defining an annular groove;

a radially protrusion in said annular groove;

an anti-rotation coupling having a plurality of balls and a mandrel whose axial movement urges said plurality of balls radially outward into said annular groove to abut said radial protrusion upon rotation of said plug relative to said anti-rotation coupling;

an anti-rotation coupling selectively coupling to said plug to limit the relative rotation of said anti-rotation coupling and said plug and to limit a bi-directional longitudinal movement of said anti-rotation coupling relative to said plug with said bi-directional longitudinal movement being parallel to said longitudinal threaded hole;

a ball situated within said radial bore and free to protrude radially outward beyond said exterior of said plug and engage said annular edge of said retainer;

a pin having external threads engaging said longitudinal threaded hole of said plug, said pin having a driving end and a driven end, said driving end being adapted to positively engage said ball, said driven end being recessed within said plug; and a key rotatable within said anti-rotation coupling, said key being adapted to reach into said plug and engage said driven end of said pin, whereby revolution of said key turns said pin selectively in and out of said longitudinal threaded hole of said plug for moving said ball along said radial bore to selectively engage and disengage said ball from said retainer.

13. The barrel lock of claim 12, further comprising an O-ring disposed in said plug.

* * * * *